US006181905B1

(12) United States Patent
Ohta et al.

(10) Patent No.: US 6,181,905 B1
(45) Date of Patent: Jan. 30, 2001

(54) IMAGE HEATING APPARATUS

(75) Inventors: Tomoichiro Ohta, Shimizu; Takashi Fujita, Shizuoka-ken; Osamu Watanabe; Ryuichiro Maeyama, both of Yokohama; Yasuhiro Hayashi, Mishima, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/480,860

(22) Filed: Jan. 11, 2000

(30) Foreign Application Priority Data

Jan. 22, 1999 (JP) ..... 11-013930

(51) Int. Cl.[7] ..... G03G 15/20
(52) U.S. Cl. ..... 399/328; 219/619; 399/330
(58) Field of Search ..... 399/328, 399, 399/330, 331, 332, 334; 219/600, 619, 622, 624, 652

(56) References Cited

U.S. PATENT DOCUMENTS 5,552,582 9/1996 Abe et al. ..... 219/619
5,568,240 10/1996 Ohtsuka ..... 355/285

*Primary Examiner*—Arthur T. Grimley
*Assistant Examiner*—Hoan Tran
(74) *Attorney, Agent, or Firm*—Fitzpatrick, Cella, Harper & Scinto

(57) ABSTRACT

The present invention relates to an image heating apparatus, in which an end of a first magnetic portion and an end of a second magnetic portion are present within a width along a recording material moving direction of a nip, and a width of a gap along a recording material moving direction is different with respect to a direction which is orthogonal to the recording material moving direction.

10 Claims, 5 Drawing Sheets

IMAGE HEATING APPARATUS

BACKGROUND OF THE INVENTION

1. Field of the Invention

The present invention relates to an image heating apparatus (heating apparatus of an electromagnetic induction heating system) which is used as a fixing apparatus for heating/fixing hot melting type powder images (visualizing agent images) such as toner on a recording material (recording sheet) in image forming apparatuses such as an electrophotographic copying machine and a printer.

2. Related Background Art

In conventional image forming apparatuses such as an electrophotographic copying machine, a heat roller system apparatus is for general use as an image heating/fixing apparatus.

FIGS. 7A, 7B are schematic views showing one example of the heat roller system image heating/fixing apparatus. The apparatus is provided with a pair of rotary rollers comprising a fixing roller (heat roller) 100 as a heating rotary member with heat sources such as a halogen heater (halogen lamp) H1 incorporated therein and a pressurizing roller 200 pressed in contact with the fixing roller to form a heating nip portion (fixing nip portion) N. In the apparatus, a recording material P bearing a formed and unfixed toner image t as the material to be heated is introduced to the heating nip portion N which is a roller pair pressed portion and pinched and conveyed so that the unfixed toner image t is heated/pressurized on the surface of the recording material P and fixed (heated and melted) as a permanent fixed image.

The surface temperature of the fixing roller 100 as the heat roller needs to be controlled and accurately maintained at a predetermined fixing temperature so that the temperature exceeds the melting point of toner t and the recording material P is prevented from being adversely affected.

Therefore, the temperature adjusting method by ON-OFF control shown in the example of a control circuit of FIG. 7C has been heretofore used in many cases. Specifically, when an alternating-current voltage is supplied between input terminals a and b, the alternating-current voltage is applied to a solid state relay SSR via a heater H1 and an operable state is obtained.

Here, the temperature control circuit (temperature adjusting circuit) starts a temperature control, this temperature (control circuit reads surface temperature information detected temperature) from a temperature detecting element (temperature measuring element) TH1 such as a thermistor for measuring the surface temperature of the fixing roller 100, compares the information with a temperature control target value, determines a proportional heater energizing time in accordance with a difference, and turns on the solid state relay SSR to start supplying power to the halogen heater or the like as the heat source H1.

Thereafter, when the surface temperature of the fixing roller 100 as the heat roller approaches the control target value, the ratio during the heater energizing is determined in accordance with the difference between the target value and the detected temperature from the temperature detecting element TH1, and the solid state relay SSR is turned on/off to stabilize the surface temperature of the fixing roller 100.

In the constitution in which the halogen heater is used as the heat source H1 to warm the fixing roller 100 as the heat roller by radiant heat, since a heater current needs to be supplied at a certain constant time interval, the surface temperature of the fixing roller 100 disadvantageously fluctuates with a certain width. Moreover, since ON-OFF is repeated at the constant time interval, an excessive rush (inrush) current flows during re-lighting the constant time after the halogen heater is turned off, and a power source flicker trouble as a recent social problem is easily caused.

Therefore, the present inventors et al. have conducted researches on an electromagnetic induction heating system heating apparatus in which a rotary member itself generates heat and heat efficiency is enhanced so that the rotary member forms no heat resistance.

The present applicant has proposed such type of apparatus in U.S. Pat. No. 5,568,240.

A magnetic field generated by magnetic field generating means, for example, by combining a core material as a magnetic member with an energizing coil is changed in an energizing circuit. Specifically, an eddy current is generated in a conductive layer of a rotary member by applying a high frequency to the coil and repeatedly generating and extinguishing the magnetic field in the rotary member as a conductive member (induction magnetic material, magnetic field absorbing conductive material) which moves in the generated magnetic field. This eddy current is converted to heat (Joule heat) by the electric resistance of the conductive layer, and as a result the rotary member adhering to the recording material generates heat. Therefore, this heating apparatus is superior in heat efficiency.

However, for the above-described conventional electromagnetic induction heating system heating apparatus, since in the nip portion, a heat radiation amount is larger in an end than in a center, the amount of heat applied to the recording material cannot be uniformed, thereby causing a problem that heating insufficiency and fixing failure are caused in the end and the toner is offset to the rotary member in the center.

Therefore, the present applicant proposes in U.S. Pat. No. 5,552,582 that the temperature distribution in a nip longitudinal direction is uniformed by adjusting a core material, adjusting a core height, or adjusting the area of the core occupying the nip.

However, the adjustment of the core material and core height tends to relatively complicate the apparatus constitution. Moreover, the adjustment of the core area which occupies the nip tends to waste the core, and further improvements have been demanded.

SUMMARY OF THE INVENTION

An object of the present invention is to provide an image heating apparatus which uniforms a temperature distribution of a longitudinal direction in a nip portion between a rotary member and a roller without any heating nonuniformity.

Another object of the present invention is to provide an image heating apparatus, which comprises a rotary member, a coil for generating a magnetic flux, first and second magnetic portions for guiding the magnetic flux generated by the coil, and a roller for forming a nip with the rotary member. An end of the first magnetic portion is opposite to an end of the second magnetic portion with a gap, the magnetic flux is guided by the first and second magnetic portions via the rotary member, an eddy current is generated in the rotary member by the magnetic flux, the rotary member generates heat by this eddy current, a recording material bearing an image is pinched and conveyed by the nip, the image is heated by the heat of the rotary member, the end of the first magnetic portion and the end of the second magnetic portion are present within a width along a recording material moving direction of the nip, and the width of the gap along the recording material moving direction differs with respect to a direction which is orthogonal to the recording material moving direction.

Further objects of the present invention will be apparent from the following description.

DETAILED DESCRIPTION OF THE PREFERRED EMBODIMENTS

Embodiments of the present invention will be described hereinafter with reference to the drawings.

Figure 6:
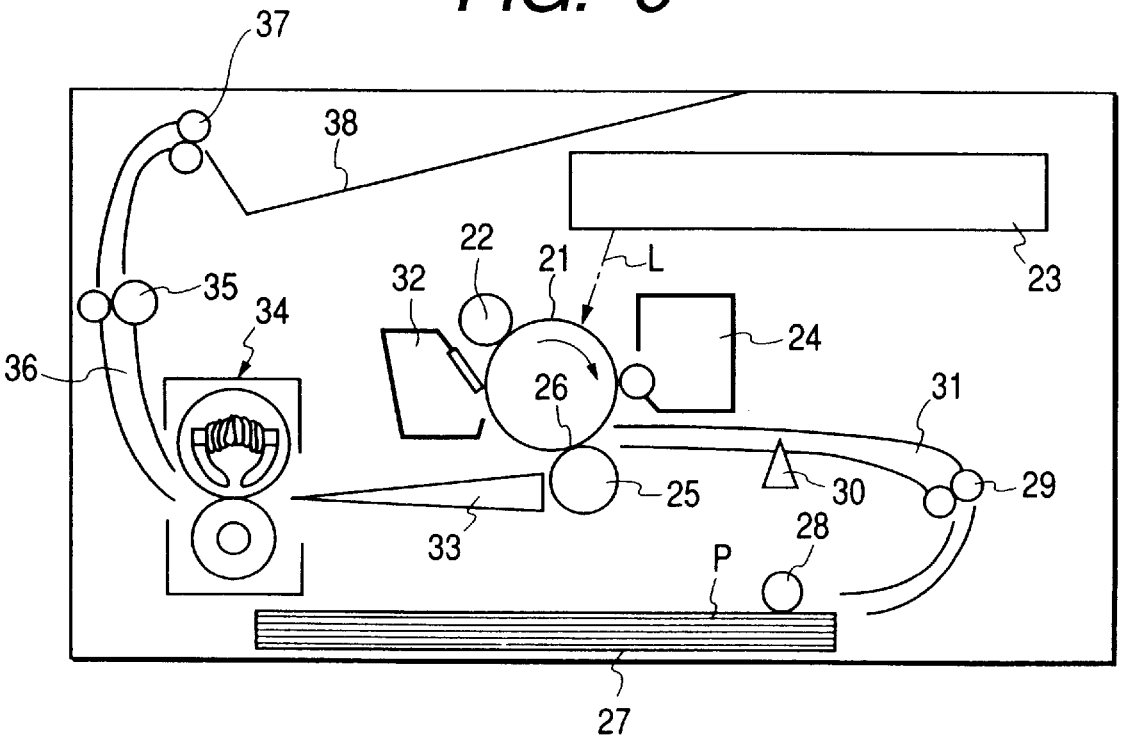
FIG. 6 is a schematic view showing the example of an image forming apparatus.
Figure 7A:
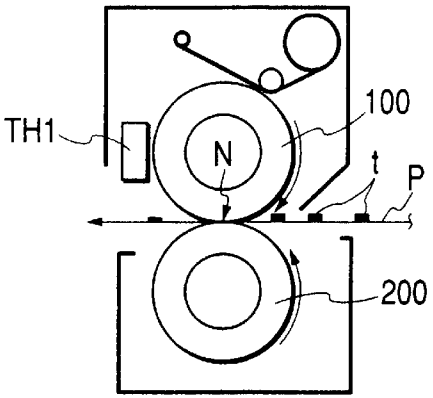
FIGS. 7A, 7B and 7C are explanatory views showing a heat roller system image heating/fixing apparatus which uses a halogen heater as a heat source.
Figure 7B:
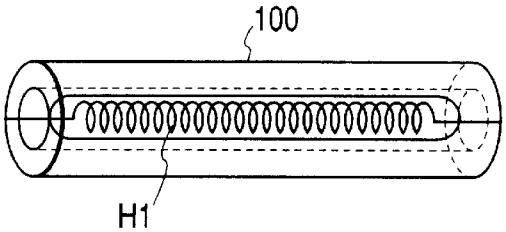
Figure 7C:
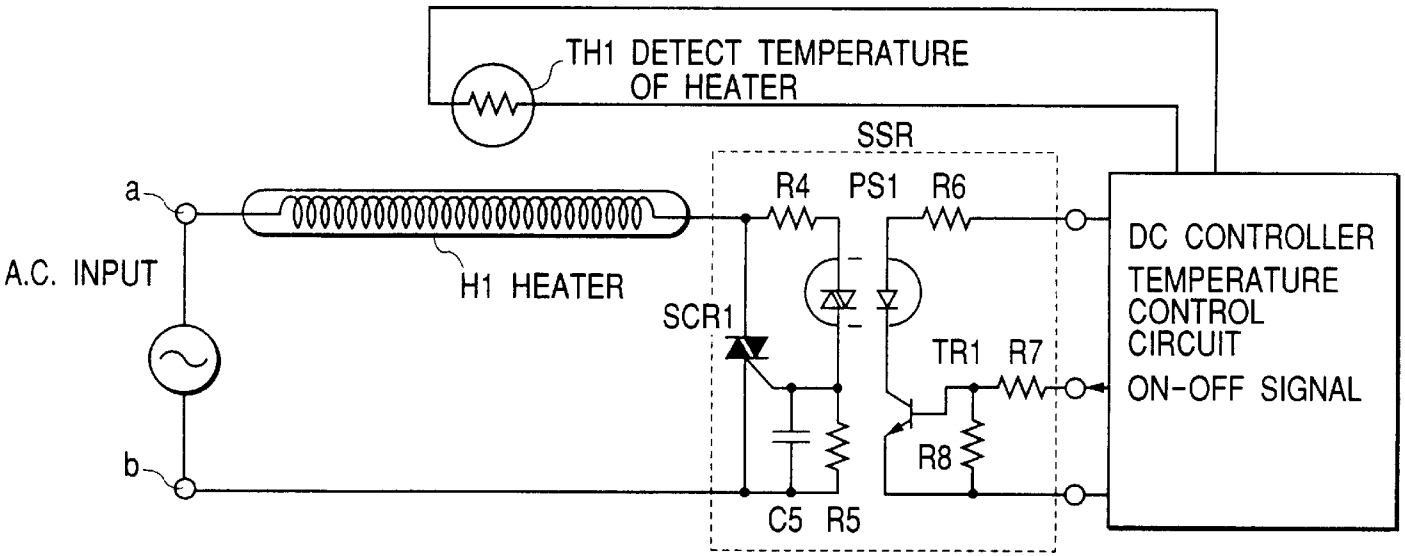

FIG. 6 is a schematic view showing one example of an image forming apparatus provided with an induction heating apparatus as an image heating/fixing apparatus. In the present embodiment, the image forming apparatus is a laser team printer which utilizes a transfer type electrophotographic process. This apparatus will first be described.

Numeral 21 denotes a rotary drum type electrophotographic photosensitive member (hereinafter referred to as the photosensitive drum) as an image bearer (image bearing member), and the member is rotated/driven with a predetermined peripheral speed (process speed) in the clockwise direction shown by an arrow.

The photosensitive drum 21 is first uniformly charged by a charging roller 22 as a charging device to provide predetermined polarity and potential in its rotating process.

Subsequently, the drum is subjected to a laser beam scanning exposure L in accordance with a desired image information pattern by a laser optical system (laser scanner) 23 as an exposure device. Thereby, an electrostatic latent image is formed on the surface of the photosensitive drum 21 in accordance with the desired image information pattern.

The electrostatic latent image formed on the surface of the photosensitive drum 21 is toner-developed and visualized by a developing device 24. As a developing method, a jumping developing method, a two-component developing method, and the like are used, and a combination of image exposure and reversal developing is used in many cases.

The toner image formed on the surface of the photosensitive drum 21 is successively transferred onto the recording material (transfer material) P fed to a transfer nip portion 26 from a sheet feeder 27 in a predetermined control timing in the transfer nip portion 26 formed by the photosensitive drum 21 and a transfer roller 25. The toner image on the photosensitive drum 21 is successively transferred onto the sheet P by applying a voltage with a polarity opposite to the charging polarity of the toner to the transfer roller 25.

In the image forming apparatus of the present embodiment the sheet feeding portion 27 is a sheet feed cassette. One sheet of the recording material P stacked/stored in the sheet feed cassette is separately fed by a sheet feed roller 28 and a one-sheet separating member (not shown), passed through a sheet path 31 including a conveying roller pair 29 and a top sensor 30, and fed to the transfer nip portion 26 in a predetermined control timing.

For the recording material P supplied to the transfer nip portion 26 through the sheet path 31 from the cassette sheet feeding portion 27, its leading end is recognized by the top sensor 30 disposed midway in the sheet path 31, and an image is synchronously formed on the photosensitive drum 21.

The recording material P with the toner image transferred thereto by the transfer nip portion 26 is successively separated from the surface of the photosensitive drum 21, passed through a guide 33, conveyed to a fixing apparatus 34, and subjected to a heating/fixing processing of the toner image in the fixing apparatus. The fixing apparatus 34 is an induction heating apparatus.

The recording material P with the fixed image passed out of the fixing apparatus 34 is passed through a sheet path 36 including a conveying roller pair 35 and discharged to a discharge tray 38 by a discharging roller pair 37.

On the other hand, after the toner image is transferred to the recording material P (after sheet separation), the transfer residual toner, sheet powder, and other adhering contaminants remaining on the photosensitive drum 21 are removed from the surface of the photosensitive drum 21 by a cleaner 32, and the photosensitive drum 21 with its surface cleaned is repeatedly used for image formation.

Figure 1:
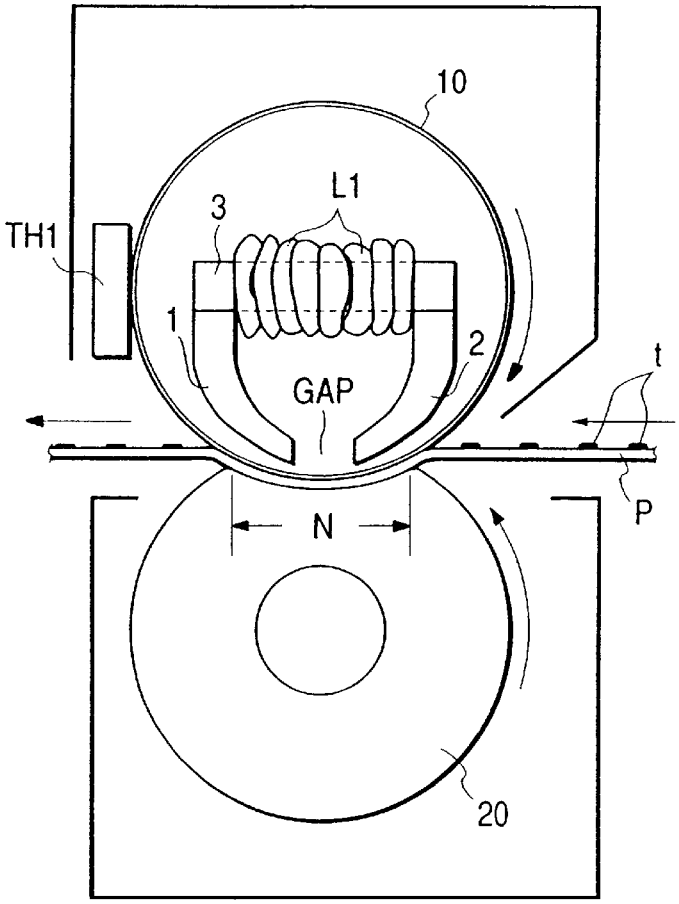
FIG. 1 is a schematic view of an induction heating apparatus (image heating/fixing apparatus) according to an embodiment.

FIG. 1 is a schematic view showing an example of the induction heating apparatus according to the present invention, and the apparatus of the present embodiment is an image heating/fixing apparatus.

(1) Apparatus Constitution

This image heating/fixing apparatus is mainly constituted of a fixing roller 10 which is a heat roller as a heating rotary member; an elastic pressurizing roller 20 as a pressurizing rotary member disposed below the fixing roller 10 and pressed onto the fixing roller 10 to form a heating nip portion (fixing nip portion) N; and a coil-core assembly of an electromagnetic converting coil (energizing coil, induction heating coil) L1 as magnetic flux generating means inserted and disposed in a hollow of the fixing roller 10, and a magnetic core 1, 2, 3 of ferrite, and the like with a high permeability.

The fixing roller 10 as a heating rotary member is an electromagnetic induction heating type cylindrical roller which is reduced in thickness to reduce a heat capacity. For example, the roller is of a iron cylinder with an outer diameter of 40 mm and a thickness of 0.7 mm. Specifically, the fixing roller 10 is a rotary member having a conductive layer.

The outer peripheral surface of the roller is provided with an about 10 to 50 $\mu$m thick coating layer of heat resistant and mold releasable resins such as PTFE and PFA in order to enhance a mold releasing property. Alternatively, surface treatments such as the plating of a metal material are applied.

As the other materials (electromagnetic induction heating material) of the fixing roller 10, for example, the materials relatively high in permeability $\mu$ and appropriate in resistivity $\rho$ such as magnetic stainless and other magnetic materials (magnetic metals) may be used.

Furthermore, even among nonmagnetic materials, thin films of conductive materials such as metals can be used.

The elastic pressurizing roller 20 is constituted by providing the outer periphery of a core metal with an elastic layer, and a mold releasable layer.

The fixing roller 10 and the pressurizing roller 20 are vertically pressed to each other and rotatably incorporated in an apparatus housing via bearings, and the pressurizing roller 20 is pressed onto the fixing roller 10 toward the rotation axis of the fixing roller 10 by a pressurizing mechanism using a spring, and the like so that the heating nip portion N with a predetermined width along a recording material moving direction is formed between the rollers 10 and 20.

The fixing roller 10 is rotated/driven with a predetermined peripheral speed in the clockwise direction shown by an arrow by a driving system (not shown). The pressurizing roller 20 follows the frictional force with the fixing roller 10 in the heating nip portion N and rotates.

Figure 2:
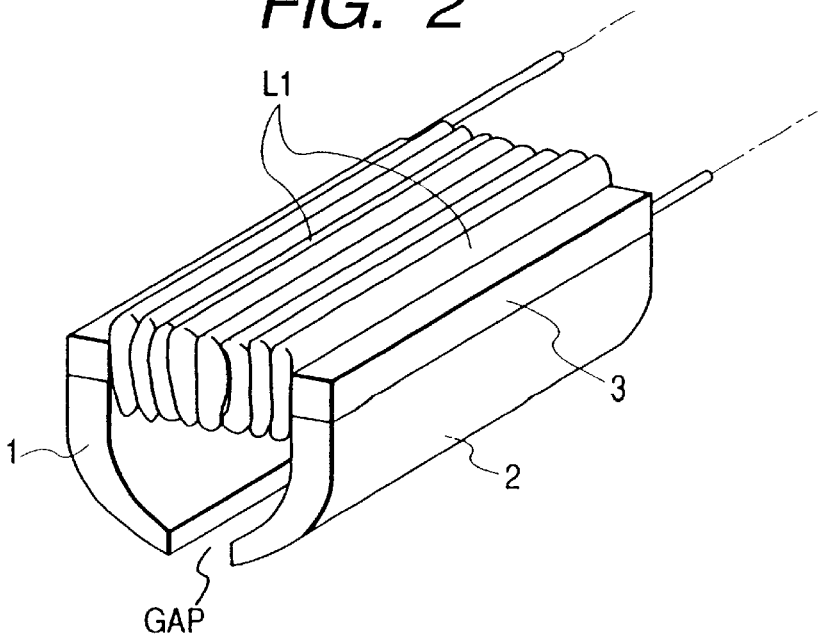
FIG. 2 is a perspective view of a coil-core assembly as magnetic flux generating means.

The coil-core assembly L1, 1, 2, 3 as the magnetic flux generating means is a longitudinal member along the rotation axis of the fixing roller. FIG. 2 is an appearance perspective view of the coil-core assembly L1, 1, 2, 3. This coil-core assembly L1, 1, 2, 3 is inserted to the hollow of the fixing roller 10 so that the assembly does not contact the inner surface of the fixing roller, and fixed/held by a support stay (not shown) in a non-rotating manner.

Figure 3A:
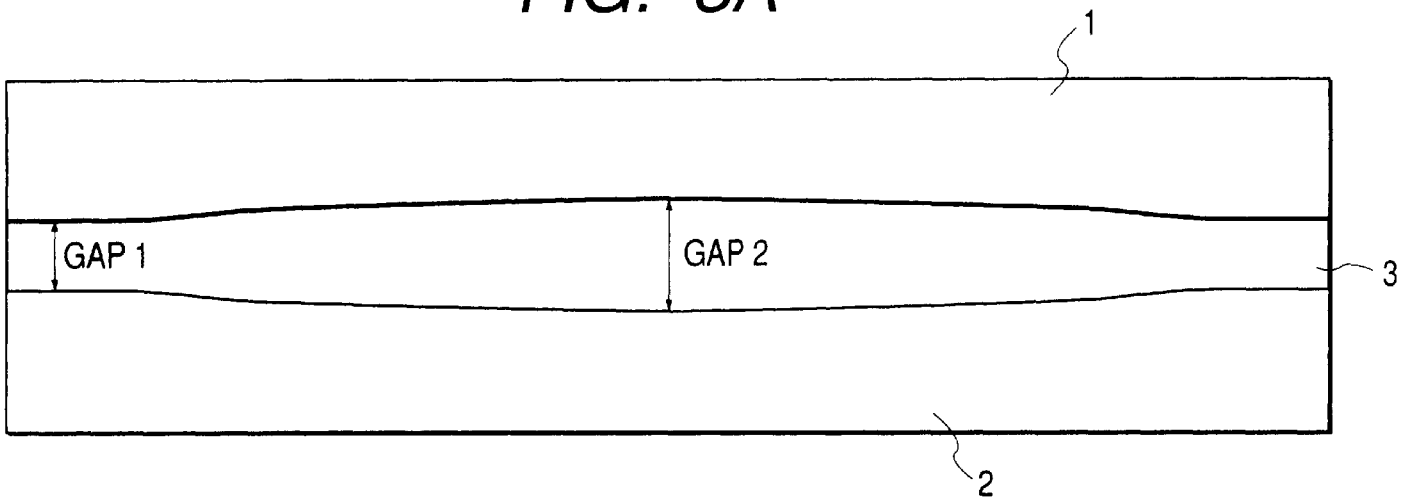
FIG. 3A is a bottom plan view of a core.
Figure 3B:
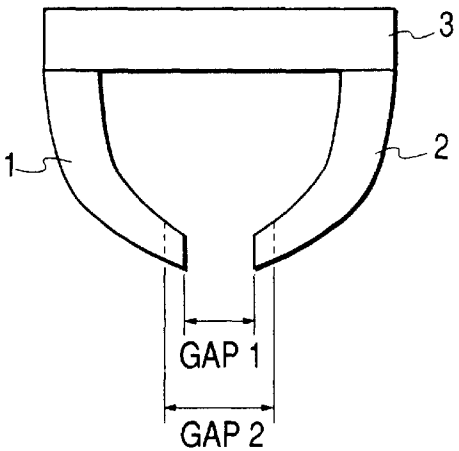
FIG. 3B is a side view of the core.

FIGS. 3A and 3B are a bottom plan view and a side view only of the core 1, 2, 3 in the coil-core assembly L1, 1, 2, 3. The core 1, 2, 3 of the present embodiment is a combination of a core portion 3 as a third magnetic portion whose transverse sectional face wound with the electromagnetic converting coil L1 is of I shape; and two magnetic flux inductive core portions 1, 2 as first and second magnetic portions with transverse sectional faces of J shape, which are disposed opposite to each other via a gap of a magnetic space distance (space gap) between tip ends, so that the magnetic flux is concentrated on a part of the fixing roller 10 as the heating rotary member from the core portion 3. Specifically, the first and second magnetic portions 1 and 2 are disposed on both ends of the third magnetic portion 3 in the moving direction of the recording material. Additionally, the "transverse sectional face" indicates the face seen from the direction orthogonal to the recording material moving direction.

Furthermore, while the space gap between the tip ends of the Magnetic flux inductive core portions 1, 2 is positioned along the heating nip portion N and disposed in the vicinity of the inner surface of the fixing roller 10, the coil-core assembly L1, 1, 2, 3 as the magnetic flux generating means is disposed in the fixing roller 10. Specifically, the end of the first magnetic portion 1 and the end of the second magnetic portion 2 are present in the width (N) of the nip portion along the recording material moving direction.

In the above-described coil-core assembly L1, 1, 2, 3 as the magnetic flux generating means, the electromagnetic converting coil L1 generates a high-frequency magnetic field by applying a high frequency current. The core 1, 2, 3 constitutes a magnetic circuit to organically bond the high-frequency magnetic field by the electromagnetic converting coil L1 to the inner surface of the fixing roller 10. Specifically, the magnetic flux is guided to the core 1, 2 via the fixing roller 10.

In the present embodiment, in the core 1, 2, 3, the core portion 3 having the transverse sectional face of I shape wound with the electromagnetic converting coil L1, and the core portions 1 and 2 having the transverse sectional face of J shape as the magnetic flux inductive core portions are separate components, and particularly the core portion 3 having the transverse sectional face of I shape wound with the electromagnetic converting coil L1 is formed like a flat plate. Therefore, after the electromagnetic converting coil L1 is wound around a bobbin slightly larger than the core portion 3 and shaped, the core portion 3 can be inserted, thereby obviating the necessity of a special winding technique.

(2) Apparatus Driving Circuit a) Circuit Configuration

Figure 4:
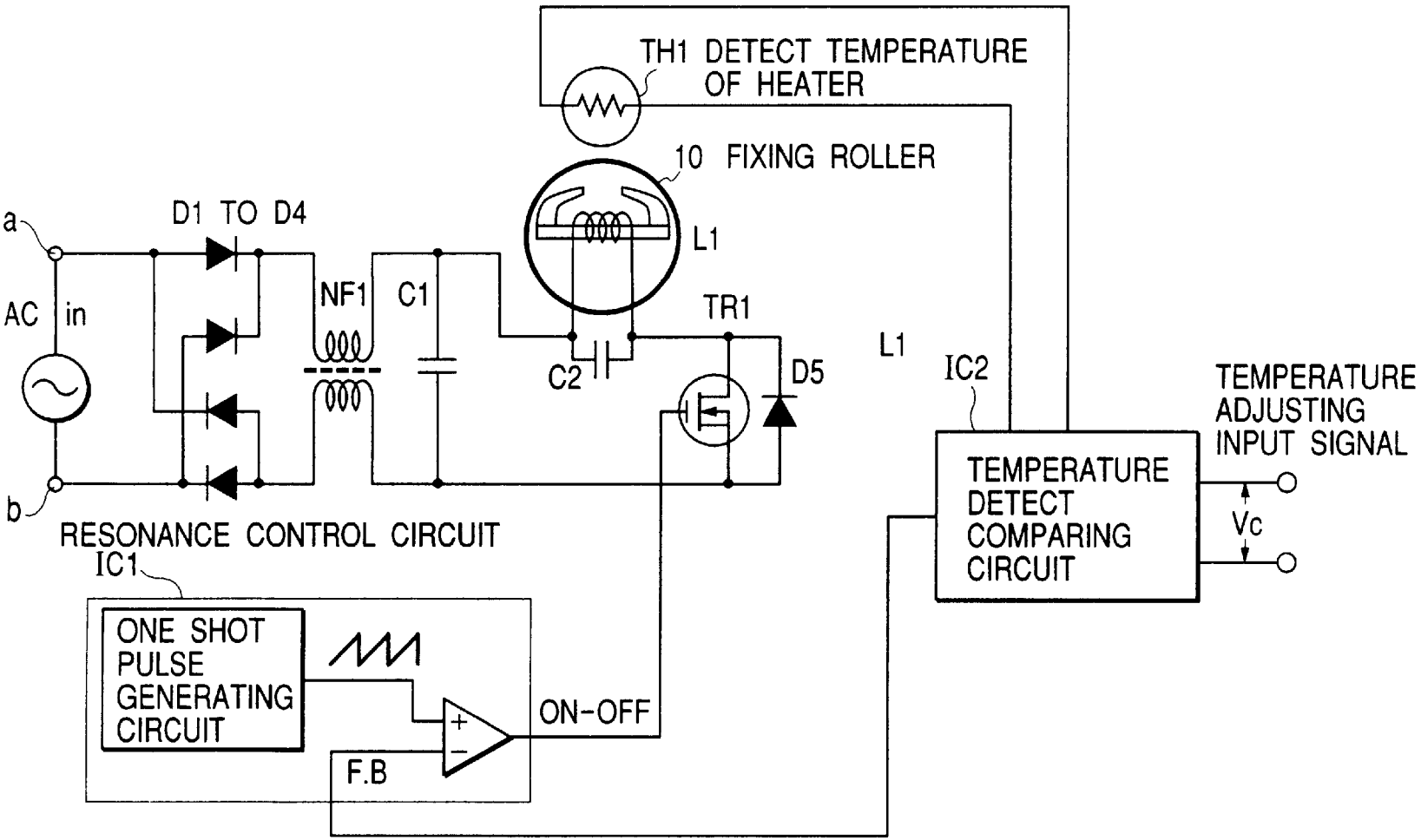
FIG. 4 is a block explanatory diagram showing an apparatus driving circuit.

FIG. 4 is a block diagram showing the driving circuit of the fixing apparatus.

While TR1 denotes MOS-FET of a power switching element (power control element), L1 denotes the electromagnetic converting coil (induction heating coil) as a circuit power load, and D5 denotes a flywheel diode which regenerates the power accumulated in the electromagnetic converting coil L1.

A temperature detecting element (temperature measuring element) TH1 is thermally bonded to the fixing roller 10, and its output is inputted to a temperature detection comparing circuit IC2.

The temperature detection comparing circuit IC2 compares a temperature adjusting input signal with the output of the temperature detecting element TH1, and inputs a difference as a control signal to a pulse (frequency) modulation (hereinafter referred to as PFM) oscillating circuit by a resonance control circuit IC1.

The resonance control circuit IC1 generates PFM pulse in accordance with a control signal value, outputs the pulse to MOS-FET gate of the power switching element TR1, and switches/drives the power switching element TR1.

Alternating-current input power rectifying diodes D1 to D4 supply pulsating currents obtained by rectifying the alternating-current power to a power control circuit.

A noise filtering coil NF1 and a high-frequency smoothing capacitor C1 form an input noise filter, a sufficient attenuation is secured for the switching frequency of the power switching element TR1, and a constant is set with respect to a power source frequency for passage without attenuation.

b) Control Operation

When an alternating-current input voltage is applied to input terminals a and b of FIG. 4, pulsating currents are rectified by the rectifying elements D1 to D4, and the voltage is passed through the noise filtering coil NF1 and applied to both ends of the high-frequency smoothing capacitor C1. The voltage on both ends of the capacitor C1 indicates a waveform obtained by rectifying the alternating-current input voltage.

When a temperature adjusting input signal Vc is inputted to the temperature detection comparing circuit IC2, the temperature detection comparing circuit IC2 compares the output of the temperature detecting element TH1 with the temperature set value of the input signal Vc.

The compared output is applied as the control signal to the PFM oscillating circuit of the resonance control circuit IC1.

The resonance control circuit IC1 generates the PFM signal of the pulse in accordance with the control signal value, the output is applied between gate and source of the power switching element TR1, the power switching element TR1 is switched by the output pulse of the resonance control circuit IC1, a drain current ID flows, and the electromagnetic converting coil L1 is energized.

Moreover, the electromagnetic converting coil L1 stores the current which flows when the power switching element TR1 turns on. Therefore, when the power switching element TR1 turns off, a counter-electromotive force is generated, a forward current is passed through the flywheel diode D5, and a capacitor C2 is charged with the accumulated current.

Subsequently, when the power switching element TR1 turns on again, the current flows to the electromagnetic converting coil L1 and is accumulated in the electromagnetic converting coil L1. Since this is repeated, a resonance current flows between the electromagnetic converting coil L1 as the load and the capacitor C1.

For the current flowing through the power switching element TR1 and the electromagnetic converting coil L1, a high-frequency component is charged/discharged and smoothed by the capacitor C1.

Therefore, in the input noise filtering coil NF1, no high-frequency current flows and only the alternating-current input current rectified waveform flows.

The current flowing through the rectifying diodes D1 to D4 indicates a current waveform obtained by filtering the current waveform flown through the power switching element TR1 and electromagnetic converting coil L1 by the capacitor C1 and the noise filtering coil NF1. Therefore, the alternating-current input current waveform before rectification indicates the input current waveform similar to the alternating-current input voltage waveform, higher harmonic wave components included in the input current can largely be reduced, and the power factor of the input current of the temperature adjusting circuit in the heating/fixing circuit can largely be improved.

Moreover, the input noise filter NF1, C1 for use in this circuit is not limited as long as a filtering effect is fulfilled with respect to the high oscillating frequency by the resonance control circuit IC1. Additionally, since the capacity of the capacitor C1 and the inductance value of the noise filtering coil NF1 can be reduced, the size and weight can be reduced.

When the temperature adjusting input signal is transmitted to the electromagnetic converting coil driving power source circuit, a high-frequency alternating-current power with a frequency of about 20 to 100 KHz is generated in the output terminal of the induction heating power source.

The alternating-current power is applied to the electromagnetic converting coil L1, and the electromagnetic converting coil L1 generates an alternating-current magnetic field. In this case, the alternating-current power applied to the electromagnetic converting coil L1 changes with the object to be heated (fixing roller 10), but is usually in a range of 200 to 300 W to about several KW.

For the alternating-current magnetic field generated by the alternating-current power applied to the electromagnetic converting coil L1, by applying the high-frequency magnetic field to the fixing roller 10 from the space gap between the core portions 1 and 2 through the ferrite core portion 3 and core portions 1 and 2, the high-frequency magnetic flux flows through the fixing roller 10 and an eddy current is generated in the fixing roller.

Since Joule heat is generated on the inner surface of the fixing roller in accordance with the current value of the eddy current, the fixing roller itself generates heat.

By this electromagnetic inductive action, the fixing roller 10 generates heat and the surface temperature of the roller rises.

Here, the output of the temperature detecting element TH1 for measuring the surface temperature of the fixing roller is inputted to the temperature detection comparing circuit IC2 at any time, and compared with the heating target temperature Vc, and the difference from the target value is fed back to the resonance control circuit IC1.

In the temperature detection comparing circuit IC2, when the detected temperature of the temperature detecting element TH1 approaches the set target temperature, a proportional control for lowering the applied high-frequency power or a so-called PID control system is used, and a feedback signal is generated to keep a constant fixing roller surface temperature.

In the resonance control circuit IC1, a temperature set target value error detected by the temperature detection comparing circuit IC2 is inputted, a gate ON signal time of the power switching element TR1 is determined in accordance with the value of the error, the energizing power of the power switching element TR1 is adjusted, the power to be inputted to the electromagnetic converting coil L1 is controlled, and the heating amount of the fixing roller 10 is controlled so that the toner fixing temperature is stabilized.

In the apparatus of the present embodiment, the magnetic flux generating means comprising the core 1, 2, 3 of the magnetic members and electromagnetic converting coil L1 wound around the core is disposed in the fixing roller 10 with the electromagnetic induction heating property as the heating rotary member. The core 1, 2, 3 is provided with the core portion 3 wound with the electromagnetic converting coil L1 and the magnetic flux inductive core portions 1 and 2 disposed opposite to each other via the space gap (magnetic space distance) between the tip ends to concentrate the magnetic flux onto a part of the fixing roller 10 from the core portion 3. When the electromagnetic induction heating is locally performed in the fixing roller by applying the high-frequency power to the electromagnetic converting coil L1, the fixing roller 10 can efficiently be heated.

In the present embodiment, for the space gap between the tip ends of the magnetic flux inductive core portions 1, 2 of the coil-core assembly L1, 1, 2, 3 as the magnetic flux generating means, the core 1, 2 is molded so that the gap is widened in the central portion in the core longitudinal direction (gap 2), and is narrowed in the opposite end portion (gap 1) as shown in FIGS. 3A and 3B. Additionally, the core longitudinal direction corresponds to the longitudinal direction of the nip portion.

In the magnetic circuit configured as described above, since the magnetic flux density lowers in the wide space gap portion (gap 2) of the central portion in the longitudinal direction of the coil-core assembly L1, 1, 2, 3 as the magnetic flux generating means, the heating amount of the fixing roller portion corresponding to the space gap portion (gap 2) also lowers.

Moreover, since the space gap portion (gap 1) is narrowed in both ends, much magnetic flux passes, and the heating amount of the fixing roller portion corresponding to the space gap portion (gap 1) relatively increases, the amount of the heat which escapes to the outside from both ends of the fixing roller can be compensated, so that the temperature distribution of the longitudinal direction of the entire fixing roller can be uniformed.

Figure 5:
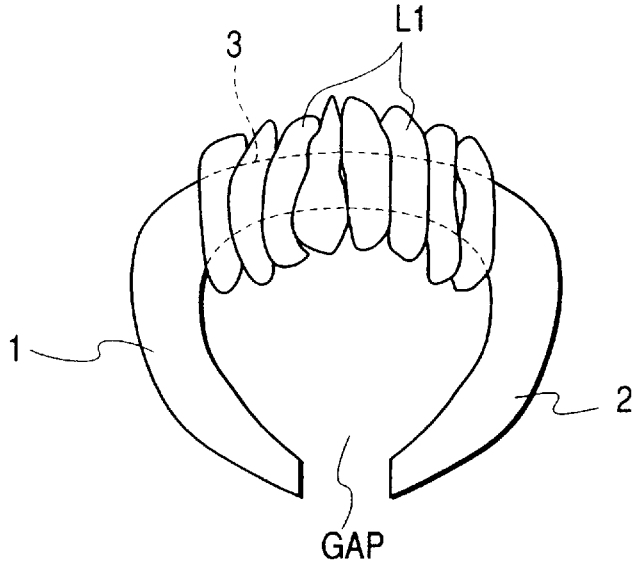
FIG. 5 is a view showing another example of the coil-core assembly.

Additionally, the core 1, 2, 3 of the coil-core assembly L1, 1, 2, 3 as the magnetic flux generating means may serially and integrally be molded of the core portion 3 wound with the electromagnetic converting coil L1 and the core portions 1 and 2 as the magnetic flux inductive core portions so that a transverse sectional face of C shape can be formed as shown in FIG. 5.

Moreover, the rotary member may be an endless film.

As described above, according to the present invention, there can be provided a heating apparatus for heating the material to be heated by the heating rotary member, which has a small fluctuating width of surface temperature without causing any power source flicker trouble and which can efficiently heat the heating rotary member. Particularly, the temperature distribution in the nip longitudinal direction is uniformed, and heating nonuniformity can be avoided.

The induction heating apparatus of the present invention is not limited to the image heating/fixing apparatus of the embodiment, and can be used as a heating apparatus for heating the recording material bearing the image to enhance the surface properties such as gloss, an image heating apparatus such as a tentatively fixing heating apparatus, further as a heating/drying apparatus of the material to be heated, a heating laminate apparatus, and as other means/apparatuses for extensively heating/processing the material to be heated.

For the image forming apparatus, the principle or process of forming the visualizing agent image on the recording material is arbitrary.

The embodiment of the present invention has been described above, but the present invention is not limited to the above-described embodiment, and can variously be modified in the technical scope of the present invention.

What is claimed is:

1. An image heating apparatus comprising:

a rotary member;

a coil for generating a magnetic flux;

a first magnetic portion and a second magnetic portion for guiding the magnetic flux generated by said coil; and wherein an end of said first magnetic portion is disposed opposite to an end of said second magnetic portion with a gap, and the magnetic flux is guided by said first magnetic portion and said second magnetic portion via said rotary member, and wherein the magnetic flux generates an eddy current in said rotary member, and said rotary member generates heat by the eddy current, a roller for forming a nip with said rotary member;

wherein a recording material bearing an image is pinched and conveyed by said nip, and the image is heated by a heat of said rotary member, and wherein the end of said first magnetic portion and the end of said second magnetic portion are present within a width along a recording material moving direction of said nip, and a width of said gap along the recording material moving direction is different with respect to a direction which is orthogonal to the recording material moving direction.

2. An image heating apparatus according to claim 1, wherein the width of said gap is smaller in an end portion than in a central portion with respect to the direction orthogonal to the recording material moving direction.

3. An image heating apparatus according to claim 1, further comprising a third magnetic portion wound with said coil, wherein said first magnetic portion and said second magnetic portion are disposed on both ends of said third magnetic portion in the recording material moving direction.

4. An image heating apparatus according to claim 3, wherein when seen from the direction orthogonal to the recording material moving direction, said first magnetic portion and said second magnetic portion are of J shape, and said third magnetic portion is of I shape.

5. An image heating apparatus according to claim 3, wherein when seen from the direction orthogonal to the recording material moving direction, said first magnetic portion, said second magnetic portion, and said third magnetic portion form C shape.

6. An image heating apparatus according to claim 3, wherein said first magnetic portion, said second magnetic portion and said third magnetic portion are integrally disposed.

7. An image heating apparatus according to claim 1, wherein said coil, said first magnetic portion and said second magnetic portion are present inside said rotary member.

8. An image heating apparatus according to claim 1, wherein said rotary member is a roller.

9. An image heating apparatus according to claim 1, wherein said rotary member is an endless film.

10. An image heating apparatus according to claim 1, wherein the recording material bearing an unfixed image is pinched and conveyed by said nip, and the unfixed image is fixed onto the recording material.

* * * * *